United States Patent [19]

Schneider

[11] 4,159,555

[45] Jul. 3, 1979

[54] SOIL-RELEASING ROLLER FOR WET OR DRY CARPET-CLEANING APPARATUS

[75] Inventor: Helmut Schneider, Mainz, Fed. Rep. of Germany

[73] Assignee: Werner & Mertz GmbH, Mainz, Fed. Rep. of Germany

[21] Appl. No.: 852,725

[22] Filed: Nov. 18, 1977

[30] Foreign Application Priority Data

Nov. 20, 1976 [DE] Fed. Rep. of Germany ..... 2652894
Feb. 28, 1977 [DE] Fed. Rep. of Germany ..... 2708681
Sep. 8, 1977 [DE] Fed. Rep. of Germany ..... 2740360

[51] Int. Cl.[2] ..... A47L 5/30
[52] U.S. Cl. ..... 15/366; 15/141 A; 15/320; 15/383
[58] Field of Search ..... 15/89, 91, 92, 141 A, 15/366, 383, 320

[56] References Cited

U.S. PATENT DOCUMENTS

| | | | |
|---|---|---|---|
| 1,919,067 | 7/1933 | Lang et al. | 15/383 |
| 2,027,938 | 1/1936 | Taylor | 15/383 X |
| 2,642,600 | 6/1953 | Jones | 15/91 |
| 3,737,937 | 6/1973 | Nordeen | 15/366 X |

FOREIGN PATENT DOCUMENTS

| | | | |
|---|---|---|---|
| 391597 | 5/1933 | United Kingdom | 15/366 |

*Primary Examiner*—Christopher K. Moore
*Attorney, Agent, or Firm*—Karl F. Ross

[57] ABSTRACT

A rapid-rotation beater or soil-loosening roller for wet or dry carpet-cleaning apparatus which has a circular axial profile and a plurality of inclined angular projections defining between them annular grooves having widths of several millimeters. The roller is formed unitarily or at least in part of a shape-retentive (rigid) material and the grooves between projections lie along a cylindrical surface.

14 Claims, 9 Drawing Figures

SOIL-RELEASING ROLLER FOR WET OR DRY CARPET-CLEANING APPARATUS

FIELD OF THE INVENTION

The present invention relates to a beater or soil-releasing roller for carpet-cleaning apparatus and, more particularly, to wet or dry carpet- or rug-cleaning devices.

BACKGROUND OF THE INVENTION

It is known to provide in wet or dry carpet- or rug-cleaning apparatus, an active element whose function it is to effect a mechanical loosening of soil from the pile, filaments or weave of a carpet and thereby promote removal of soil by a cleaning fluid in a wet-cleaning apparatus or the effect of the air stream in a dry-cleaning apparatus such as a vacuum cleaner.

In wet-cleaning apparatus as well as in dry cleaning apparatus for the removal of soil from carpets and rugs, it is, therefore, common practice to provide a motor-driven device which facilitates the pickup of the soil from the carpet.

For example, the mechanical device can be a rotating brush of any one of a number of types, the bristles of which comb through the pile of the carpet and thereby loosen the soil which normally adheres or is trapped thereby. For example, there are horizontal rotating brushes such as plate brushes and brushes which rotate around vertical axes. Other tools for this purpose are provided without bristles and operate by an impact effect, i.e. as so-called carpet beaters. Such tools generally comprise a rotor or wheel (roller) formed with a bulge or rib which beats against the carpet to loosen the soil thereon.

Beater-type tools of this kind, however, are less efficient than the rotating brushes mentioned previously in the loosening of soil and in providing the soil particles in such form as to enable them to be entrained in the suction air stream.

All of the aforedescribed devices have, however, various disadvantages.

In the case of roller brushes, the bristles sweep through the carpet in only one direction and hence it is necessary to run the carpet-cleaning machine over the rug or carpet in a number of directions. This is to insure that the entire surface of the carpet is thoroughly brushed and that the pile of the carpet is brushed from several directions.

When the carpet-cleaning machine is not displaced in various directions over any particular region, the brush tends to deflect the pile and to engage only the upwardly turned broad surface thereof. Only when the carpet is swept in the opposite direction, do the bristles have the possibility of engaging the opposite side of the pile to release any soil particles which may have been covered over by the deflected pile.

Rotary brushes also have the disadvantage that they have the tendency to untwist long filaments of pule from the carpet and to draw them out of the pile strands.

Another disadvantage of brushes of the aforedescribed type is that contaminants, torn-off filaments or threads and the like tend to accumulate at the roots of the bristles so that the brush, as a whole, tends to grow in size. Unless time-consuming brush cleaning is carried out, the brush is rendered unusable in short order or tends to transfer the soil particles and other material picked up by the brush to the next carpet to be cleaned.

Impact rollers of conventional design have the disadvantage, in addition to the lower efficiency than the brushes, that they tend to flatten the pile of the carpeting and frequently have the same disadvantages as the brushes in that they must be moved across the carpeting in several directions.

It has been attempted to avoid these disadvantages in both wet and dry cleaning machines to provide rapidly operating rollers which have a profile formed by annular projections leaving annular grooves between them.

Such rollers are described for a wet carpet-cleaning apparatus in U.S. Pat. No. 2,407,408, for example, and for a dry carpet-cleaning apparatus in U.S. Pat. No. 2,476,537.

The carpet-working roller of the last-mentioned patent comprises inclined elliptical rings which, because of their inclined orientation on the inner member of the roller, have a circular axial profile, i.e. viewed along the axis of the roller, the projections are seen to have a circular outline.

The inclined orientation of these annular disks has the effect that at each region of the carpet swept by each disk, for every rotation of the roller, the pile is displaced axially to one side and then to the opposite side.

This lateral back and forth movement occurs as the roller is displaced transverse to its axis along the carpet. As a result, the soil trapped in the pile and between the strands of the pile is loosened readily and the pile is never bent over to the point that portions of the pile remain unswept by the projections.

Investigations have shown, however, that the rollers of this construction are not completely effective because they consist of elastically deformable material. These investigations have demonstrated, moreover, that the use of a yieldable material has the tendency to limit the back and forth movement of the pile. The elastic material was chosen to prevent damage to the carpet but, in fact, had the effect of reducing the soil-loosening efficiency of the device.

Indeed, because the elastically yieldable material is itself bent back and forth by a resistance of the pile upon rotation of the roller, the annular disks develop residual necks, bends and edges which sharply increase the wear of the roller and the tendency to damage the carpet by seizing filaments of the pile. In many cases, moreover, the material is so yieldable and the pile so dense that the yieldable material of the profiled roller does not penetrate sufficiently deeply between the fibers of the carpet to effect a back and forth oscillation thereof.

Lateral forces upon the roller are also not completely transferred to the carpeting as a result the annular profiles, because of their yieldability, take up, to a large measure, these lateral forces.

Apparently, this was recognized in the development of the aforedescribed prior art roller since, in the last-mentioned patent, there is described a system for compensating for the lateral forces. To this end, half of the roller is provided with annular disk projections which are inclined in one direction while the other half of the roller has inclined disk projections oriented in the opposite direction.

This construction has been found to have the disadvantage that, in the center of the roller, no annular disk projections can be provided and hence a central strip of the carpet swept by the roller remains unagitated thereby. In practice, therefore, this profiled roller has not received widespread acceptance in the carpet-cleaning art.

OBJECTS OF THE INVENTION

The principal object of the present invention is to provide an improved soil-loosening roller for a wet or dry carpet-cleaning apparatus whereby the disadvantages of earlier systems are avoided.

Another object of this invention is to provide a carpet-cleaning apparatus of the wet or dry type having improved soil-loosening means.

It is an object of the invention to provide a soil-loosening roller for a carpet-cleaning apparatus which can be motor driven and which does not impart oscillations to the machine housing in which the roller is journaled but yet is capable of imparting to the carpet pile a back and forth soil-loosening agitation without requiring the machine to be passed a number of times in different directions over any particular region.

SUMMARY OF THE INVENTION

These objects and others which will become apparent hereinafter are attained, in accordance with the present invention, with a motor-driven soil-loosening roller for a carpet-cleaning apparatus which comprises a shape-retentive or rigid (nonyieldable) body of generally cylindrical configuration and circular cross sectional outline, formed with a plurality of annular projections defining between them annular grooves of a width (measured in the axial direction) of several millimeters. The annular projections are so designed, in accordance with the present invention, to penetrate deeply into the pile of the carpet to impart a soil-loosening action thereto. The roller of the present invention is distinguished from prior art rollers of the type previously described by the combination of the following essential features:

(a) the roller and its annular projections are composed of a shape-retentive, rigid, inelastic and nondeflectible material;

(b) the groove-defining surfaces of the annular projections, i.e. the flanks of these projections, have generatrices which are radial, i.e. extend perpendicular to the axis of the roller and hence to the root of the groove, so that surfaces or flanks are perpendicular to the roots of the grooves over the entire periphery of each annular projection defining a side of the respective groove; and (c) the annular projections are inclined to the axis of the roller and are geometrically identical but are angularly offset from one another along the length of the roller so that, between the annular projections at the end of the array thereof, each annular projection is angularly offset from the next annular projection by an angle corresponding to 360°/n or 360°/n·a where n is the number of angularly spaced projections of the array and a is defined below.

Since the profile of the soil-loosening roller consists of a shape-retentive nonyieldable body in the form of an elliptical inclined angular projection whose largest diameters are not perpendicular to the axis of rotation but are inclined thereto, the radially outermost portions of each projection upon rotation of the roller, undergo an axial excursion from side to side, corresponding to the pitch of the particular annular projection. When viewed along the axis, however, each of these elliptical annular projections appears to have a circular outline, i.e. a projection of the periphery of each projection in a plane perpendicular to the axis of the roller is a circle. Thus, the entire roller has a circular projection in this plane. When the roller is driven about this axis, therefore, each of the annular projections in engagement with the pile of the carpet, alternately displaces the pile to the left and to the right, i.e. in one axial direction and then the other at high speed.

The annular disk projections are spaced apart by distances of several millimeters from one another upon the core of the roller and define the aforementioned annular grooves between them. The upstanding pile of the carpet can penetrate into these grooves.

When the roller is driven at speeds of, for example, 1000 rpm, the pile between one yieldable rigid outline projection is agitated back and forth transverse to the direction of advance of the roller over the carpet and, if the depth of the grooves is relatively great, i.e. 7 to 8 mm, this agitation and vibration as well as the friction of the projection against the carpet fibers, can be effective to the very depths of the carpet so that the soil-loosening action is equivalent to that obtained with a rotating brush without the disadvantages thereof enumerated previously.

If, unlike the construction of the roller of the present invention, the elliptical annular disk projections would be of flat planar configuration, the flanks of each groove would be inclined to the root or floor thereof. In this case, the fibers which are engaged during agitation in one direction would be differently engaged from the fibers of the reverse action. This is avoided with the configuration of the present invention in which the annular disk projections deviate from a flat plane and have their groove-defining flanks over the entire periphery of each projection or circumference of each groove radially perpendicular to the roller axis. As a result, the penetration of the annular projection into the carpet material is improved and the cleaning and agitation effect is augmented while maintaining the original condition of the carpet pile.

Naturally, if all of these inclined elliptical annular projections were provided over the length of the roller in mutually parallel relationship, they would all simultaneously displace the pile either to the left or to the right upon rotation of the roller. Since all of the reaction force would then be applied in the opposite direction to the roller, the machine would be displaced in the opposite direction.

Since the reaction forces applied by the carpeting to the machine will change in direction with rotation of the roller, at high rotation speeds considerable vibration develops in the machine.

The present invention provides, as stated in paragraph (c) above, that the annular projections are angularly offset from one another along the length of the roller progressively so that the total angular offset over the length of the roller, i.e. from one end to the other, corresponds to a 360° rotation of the ring projection about its axis.

In other words, if n represents the number of axially spaced annular elliptical projections provided along the length of the roller, each projection is angularly offset from the next projection by 360°/n. As a result, for each full revolution of the roller, each projection will be swept through 360° and alternately develop a reaction force which is from left to right and right to left. However, at any instant, the sum total of the reaction forces in one axial direction will be equal to the sum total of the reaction forces in the opposite axial direction.

There is, therefore, in accordance with the principles of the present invention, no net axial force on the roller or, therefore, upon the machine in which the roller is journaled. Furthermore, the annular projections can be distributed over the full length of the roller so that central regions or other portions thereof need not be free from projections to leave unagitated strips of the carpet when the machine is displaced over the latter. Unlike prior art systems which manage to achieve a force balance, therefore, the central region of the roller is not free from active elements, e.g. the annular projections, which engage the carpeting.

Because of the progressive or stepwise angular offset of the annular disk projections and hence the stepwise or progressive changes in the inclinations thereof, it is possible not only to obtain a complete vibration of the carpet pile along the length of the roller in all positions and at all speeds thereof, but it is possible to provide annular grooves which have a substantially constant depth and thus increase the soil-loosening effect on deep pile. Unlike systems in which all of the angularly inclined rings lie in parallel planes and have the same orientation at least over half of the roller, the grooves between these projections no longer have their smallest depth along one side of the roller.

As a consequence, the penetration of the pile into the grooves is progressive in that it takes place to different degrees along the length of the roller and hence the interaction between the roller and the pile is made more intense.

This improves the effect of any cleaning liquid or facilitates loosening of the particles so that they can be drawn away by the vacuum-entrained air.

It has been found that the efficiency of the roller is improved so that it approximates that of rotating brushes only when all three of the conditions (a), (b) and (c) are combined. Furthermore, there is little tendency of soil particles or threads to accumulate in the grooves and both deep-pile and shallow-pile carpets can be readily cleaned with the rollers.

According to another feature of the invention, the degree of inclination of the annular disk projections, i.e. the ratio of their largest diameter to smallest diameter, is selected to be sufficiently great so that the outermost edges of the projections have an axial excursion which overlaps the axial excursions of the adjacent annular disk projections. In other words, each outermost portion of an annular disk projection has an axial "throw" which extends to opposite sides of a median radial plane by a distance which is in excess of the width of the annular gap adjacent the respective projection. The throw of each projection, as thus defined, can overlap the throw of an adjacent annular disk projection, i.e. the annular disk projection defining the other side of each gap or groove flanking the respective projection.

This ensures that even with short-pile carpet there is a complete displacement of all of the pile back and forth and, more-over, a complete stroking of the entire pile surface whether the pile is short or long.

It is advantageous, in accordance with the present invention that the amplitude of displacement or throw of each annular disk projection be about 15 mm. Since, in practice, the pile does not have a length in excess of 15 mm, this amplitude of displacement of the outer portion of each annular disk formation upon a full revolution of the roller is sufficient for most purposes.

It should be noted that with deep-pile carpeting, the pile should be thoroughly scrubbed by the annular disk projections. When the latter have an axial amplitude, for each rotation, of 15 mm and an annular groove width of 6 mm, the pile is doubly overlapped so that each point of the carpet is at least twice scrubbed or scraped by edges of the projections. In other words, each point on the carpet is engaged by two such annular disk projections.

Advantageously, the roller has thirty-one annular disk projections i.e. thirty projections not counting the first. In this case n represents the number of projections other than the first and equals thirty. The angular offset between the projections is, in each case, one-thirtieth of 360° and thus 12°. Thus the last ring has the same orientation as the first.

This arrangement of the annular disk projections, both as to dimension, number and width of the annular grooves, has been found to give an optimum working of the carpet in a wet cleaning apparatus.

The pile of the carpeting is not excessively compacted or distressed when the roller is constituted of a form-retentive, impact-resistant synthetic resin such as a polyamide (e.g. nylon or delrin) or a polypropylene. These materials have low wear themselves and bring about little wear of the wet pile of a carpet. They tend not to be plugged readily by contaminants and thus have a long useful life without cleaning. This is the case even if the carpeting which is to be cleaned is extremely dirty.

The annular projections of the present invention thus also increase the useful life of the roller to a multiple of the useful life of brush rollers no matter what the configuration thereof.

The roller of the present invention has been found to operate cleanly with practically unlimited speed and with an optimum soil-loosening effect both for dry carpet cleaning and wet carpet cleaning.

When the roller is used for the drycleaning of a carpet, it preferably consists of a thermally conductive material such as chrome-plated aluminum or steel.

This precludes local overheating as a result of frictionally generated heat at the surfaces of the annular disk projections. Furthermore, since local overheating does not occur, there is no danger that the roller may stand from time to time in contact with the temperature-sensitive pile of the carpet.

The device can be provided with automatic means for switching off the roller arrangement when the roller has been used for a time corresponding to that at which heat may be generated at a detrimental level. The automatic cutoff of the electric current to the motor can be effected with the aid of a pressure or traction switch which becomes effective when the operating handle of the machine is released by the user. Naturally, this will prevent excessive heat generation because of a standstill of the machine and continued rotation of the roller.

For effective transport of the soil particles loosened by the roller into the vacuum cleaner (dry carpet cleaner), the apparatus is preferably constructed as follows:

The rotating soil-loosening roller is yieldably mounted in the housing of the machine to follow unevenness of the carpet pile, i.e. to be raisable and lowerable in the suction nozzle passage of the vacuum cleaner.

The distance between the soil-loosening roller and the air intake portion of the machine should be made as small as possible so that the airstream is deflected across the roller and through the annular grooves between the annular disk projections thereof.

The overall weight distribution of the device should be such that a uniform pressure is applied to the soil-loosening roller and the nozzle edge of the suction opening over their entire length while the apparatus is in operation.

It has been found to be advantageous, in the case of a vacuum cleaner, i.e. a dry-operating carpet cleaner, to provide the soil-loosening roller such that its annular disk projections along the corresponding periphery of the rollers are bent axially to one side and the other a number of times. This can be achieved by forming each annular disk projection as a corrugated or undulating element. As a consequence, for each revolution of the roller, the excursion of outer edges of each annular disk projection to opposite axial sides is increased per revolution.

The multiple-bend arrangement creates a directional change in the action upon the carpet pile several times per revolution so that a correspondingly reduced speed can be used to gain the same cleaning effect. The advantage of this reduced speed operation when there is no cleaning liquid to take up the friction heat generated by the soil-loosening roller and the heat transfer to the soil-entraining airstream takes place at reduced efficiency, is that the amount of friction heat generated is correspondingly lower.

So that portions of the carpet pile do not remain unagitated, the amplitude of the back and forth movement of the pile generated by two neighboring rings should overlap and the inclination of the peripheries of the rings should not approach the axis of the roller too closely. An excessive inclination of the ring will, of course, reduce the ability of the pile to pass between the rings.

The roller diameter can be, for example, 100 mm and each ring can this have four or more corrugations although with soil-loosening rollers of a diameter of 40 mm two corrugations will be provided per ring. Each corrugation, naturally, consists of a crest and a trough.

When annular disk projections with multiple bends are provided, the angular offset between neighboring disks need only be a fraction of the angular offset previously described so that corresponding portions of the disks achieve a full rotation through 360° along the length of the roller. Thus, when there are four corrugations per ring, the angular offset required is only one-fourth that which would otherwise be necessary so that the actual angular offset between the first and last ring need only be 90°. Nevertheless, this will result in corresponding positions of successive disks extending a full 360° about the periphery of the roller over the length thereof.

Thus the apparatus can be considered to comprise a plurality of inclined disks which have a portions lying to opposite sides of a radial median plane through the disk and perpendicular to the axis of the roller. When multiple undulations are provided, a can be 2, 4, . . . although with a simple inclination $a=1$.

The angular offset beyond the first annular disk is thus $(1/n)\times(360/a)$. This reduces to the simple case of $360/n$ where $a=1$, i.e. the annular disks are not corrugated.

An important advantage of the soil-loosening roller of the present invention is that it does not tend to accumulate dirt in the annular grooves between the annular disk projections. This is especially the case when the junctions of the flanks of these grooves, i.e. the cheeks of the annular disk projections, are rounded or filleted at their junctions with the floor of the groove. Thus, the bottom surfaces of the grooves are rounded at their low points and remain completely free of contaminants such as filaments or carpet dirt in use.

When the soil-loosening roller is employed in a dry carpet-cleaning apparatus, the rotary movement of the roller and the passage of air thereof brings about a self-cleaning effect. Naturally, when the roller is used with a wet carpet-cleaning apparatus, the carpet-cleaning liquid or "shampoo" provides an additional cleaning action.

The soil-loosening roller of the present invention can be fabricated in a single piece from synthetic resin or metal by any conventional metal-working process, e.g. a casting, injection-molding, die-casting or like operation. Naturally it can also be formed by machining (material removal) from a blank.

It has been found to be advantageous, however, to impart the desired profile to a synthetic-resin tube which is rotated relative to a cutting tool which can be moved back and forth parallel to the axis of the tube with the desired amplitude to be imparted to the annular disk projections. Cutting tools equal in number to the desired grooves may be provided and, if desired, the synthetic-resin tube can be displaced axially as well as rotated to effect the desired relative movement of the tools and the tube.

It has been found to be advantageous, in accordance with another aspect of the invention, to provide the soil-loosening roller from an assembly of individual elements or segments, each of which carries a respective annular disk projection and has a hub portion from which the projection extends outwardly. The hub portion is intended to form the floor of the groove between such annular disk portions.

The segments may be formed unitarily or may themselves be made up of a number of parts and are assembled axially with interfitting portions to produce the soil-loosening rollers.

The segments each thus have a pair of surfaces which contact the neighboring segments on opposite sides thereof.

It has been found to be advantageous to provide the juxtaposed surfaces of adjacent segments with mating or mutually engageable formations so that all of the segments are rotationally coupled with one another.

To afford the desired angular offset between the adjacent segments, moreover, the formations on the opposite surfaces of each segment are themselves angularly offset to a corresponding degree. Thus, when the segments are axially assembled and the mating formations of the adjacent segments engage, the angular offset is automatically imparted to the successive annular disk projections.

The ends of the segment assembly can be provided with portions fixed to an axis or shaft extending through the assembly and adapted to be coupled angularly thereto for driving by a motor or the like.

When especially long rollers are provided, the assembly can be centrally supported by a core and can be driven as well.

An advantage of this construction is that a failure of or damage to individual annular disk projections does not require replacement of the entire soil-loosening roller. Only the damaged portion need be removed and replaced. Furthermore, the system facilitates fabrication of the roller since all of the elements carrying the annular-disk formations can be constituted by mass production synthetic-resin fabricating techniques and can be identical.

According to a feature of the invention, the hubs which carry the juxtaposed surfaces of the adjacent segments lie substantially radially, i.e. in planes perpendicular to the roller axis, while the formations which project from these surfaces are axial projections and recesses which can be hemispherical in configuration. This construction has the advantage that there is little tendency of the segments to shift relatively to one another upon the application of axial force thereto as would be the case if the contact surfaces between the segments would be inclined to the axis of the roller.

According to yet another feature of the invention, especially in its application to vacuum cleaners and in general, dry-operating carpet-cleaning apparatus, the annular grooves between the annular disk projections previously described are formed with passages or openings which terminate-along the cylindrical surface constituting the floor of each groove. These passages communicate via the interior of the tubular roller with the external atmosphere so that additional air is drawn through the roller and through these passages to clear soil therefrom or loosen any material which may become trapped in the grooves. In addition, a flow of air through the grooves, induced by suction, improves the soil-loosening effect of the roller.

In fact, this construction has been found to eliminate a disadvantage with vacuum cleaner systems in which the suction location or nozzle cannot be brought as close as desired to the pile-agitation site.

The roller used for this purpose can have a root diameter (groove diameter) which is only 5 mm smaller than the outer diameter of the roller while retaining its cleaning effectiveness.

According to a feature of the invention, these passages are provided diametrically opposite one another in the grooves at locations corresponding to the maximum axial excursions of the respective annular projections. Thus, the jets of air from the interior of the rollers are directed at the carpet in the regions at which the pile is maximally deflected to one side or the other.

The rapid rotation of the roller imparts a centrifugal component to the outflowing airstream which supplements the forces generated by the suction effect.

According to yet another feature of the invention, the air passages have a length which is about three to four time their diameter. The diameters of the airholes can be about 1.5 mm.

It has also been found to be advantageous to provide between the hub and the sleeve portion of each segment formed with the aforementioned passages, a plurality of angularly-spaced support webs which act as spokes and stabilize the structure.

BRIEF DESCRIPTION OF THE DRAWING

The above and other objects, features amd advantages of the present invention will become more readily apparent from the following description, reference being made to the accompanying drawing in which.

SPECIFIC DESCRIPTION

Figure 1:
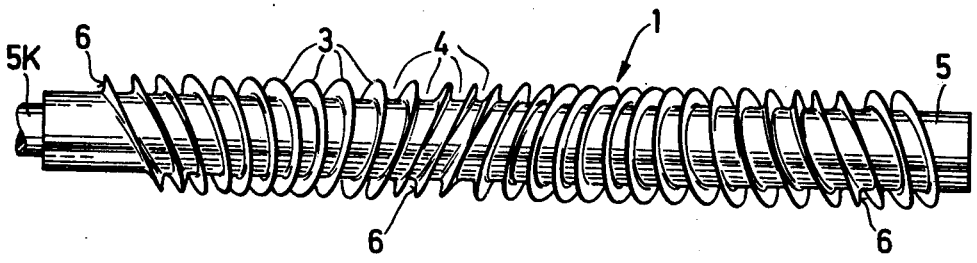
FIG. 1 is a perspective side view partly in diagrammatic form of a soil-loosening roller for a carpet cleaner in accordance with the present invention.

FIG. 1 shows in side-elevational view, a soil-loosening roller 1 which, in the manner previously described has annular grooves 4 defined between the flanks or cheeks 6 of inclined annular disk projections 3, these grooves having their floors or roots coinciding with the outer diameter of the cylindrical roller core 5. At one end (say shaft portion 5K), the roller can be provided with a pulley or engaged by a belt or coupled directly to the shaft of a motor so that it can be power driven in a carpet-cleaning apparatus.

Figure 2:
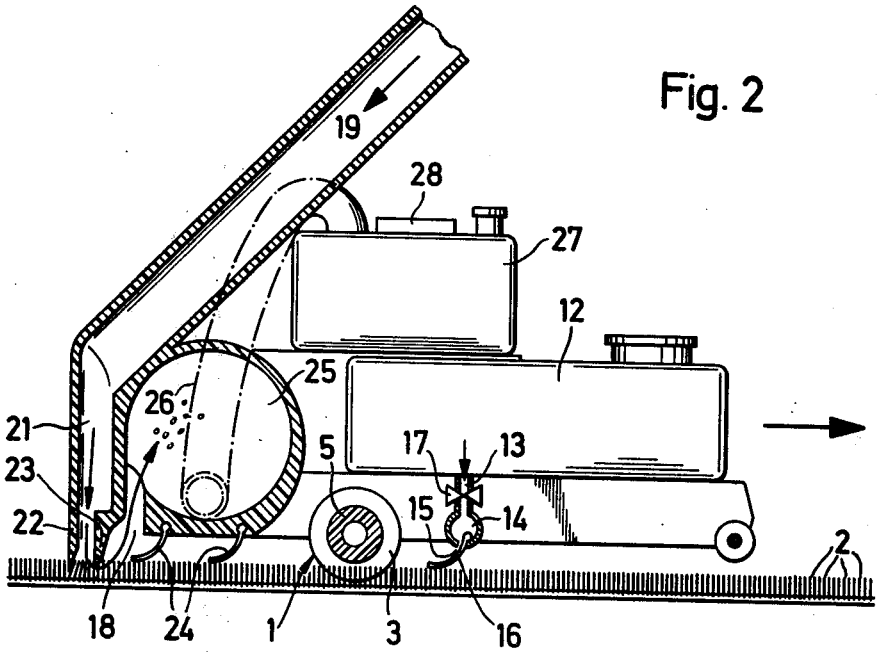
FIG. 2 is a schematic longitudinal section through a wet-operating carpet-cleaning machine illustrating one embodiment of the use of such a roller.

The carpet-cleaning apparatus shown in FIG. 2 comprises the soil-loosening roller 1 which, it may be seen, has a circular outline when viewed in projection upon a plane perpendicular to the axis of the roller, i.e. the plane of the paper of FIG. 2.

The soil-loosening roller 1 has its annular projections 3 penetrating into the pile 2 of the carpet. Above the roller 1, the apparatus is provided with a liquid tank 12 which supplies the carpet-cleaning liquid or shampoo to the surface. The tank 12 has an outlet duct 13 which opens into a transverse passage 14 for distributing the liquid uniformly parallel to the roller 1, i.e. in a direction perpendicular to the direction of advance of the carpet-cleaning machine (represented by the arrow in FIG. 2) along the carpet. The supply of liquid from the transverse passage 14 to the carpet is insured by a discharge slit 15 having a rubber tongue 16 therein and intended to wipe the dispensed liquid onto the carpet pile. The duct 13 is provided with a valve 17 which can be operated to commence or terminate flow of the liquid to the outlet nozzle 14–16.

The machine is provided with a handle 19 which is tubular and serves as a duct for delivering compressed air to the apparatus. The compressor drive motor and the motor for driving the soil-loosening roller 1 has not been illustrated.

The duct 19 widens into a transverse nozzle 21 disposed at the rear of the machine and formed between a pair of transverse sealing edges 22 and 23, referred to hereinafter respectively as the rear and front sealing edges.

The air blown into the carpet between these two sealing edges and a pair of sealing lips extending in the longitudinal direction (not shown) parallel to the direction of displacement of the machine, passes inwardly toward a suction passage 25 communicating by a suction line 26 with a collector 27 for the soil pickedup by machine. The soil settles from liquid in this receptacle 27 while air can be drawn freely from the upper opening 28 of the receptacle 27 by the compressor.

A pair of elastomeric lips 24 are provided as wipers behind the soil-loosening roller 1.

As the apparatus of FIG. 2 is drawn along the carpet, therefore, the cleaning liquid is applied and pressed by member 16 into the pile 2 of the carpet. When the roller 1 is rotated rapidly in contact with the wet pile, it agitates the latter in the manner previously discussed by displacing the pile transversely of the direction of movement of the machine to cause the liquid to foam and soil to loosen. The soil adheres to the foam. As the jet of air from the nozzle 21 picks up this foam, therefore, both the liquid and soil are carried through the passage 25 and into the receptacle 27 from which the air is withdrawn to the compressor. The carpet is thoroughly cleaned.

Figure 3:
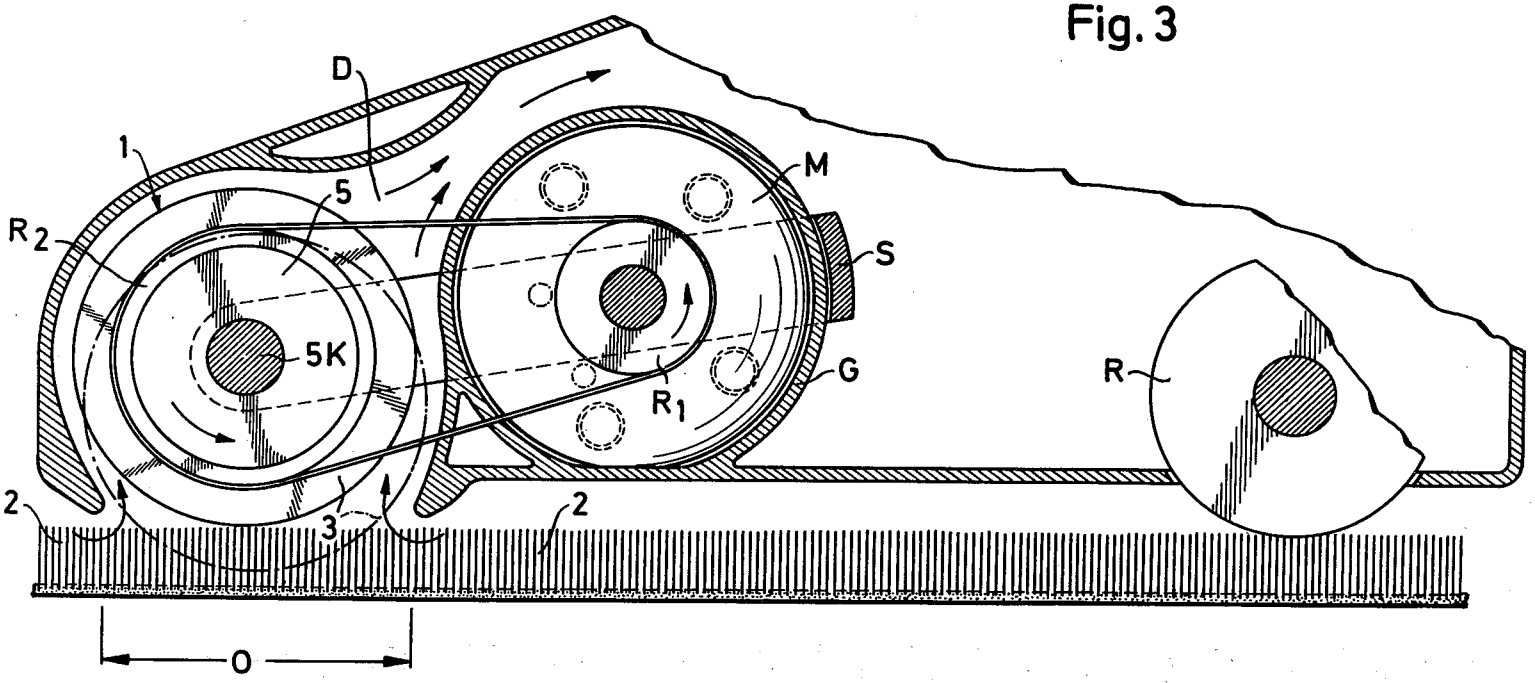
FIG. 3 is a diagrammatic partial longitudinal section through a dry-operating carpet cleaner or vacuum cleaner provided with a powered soil-loosening roller according to the invention.

FIG. 3 shows an application of the soil-loosening roller 1 to a dry-operating carpet-cleaning apparatus and, in the housing of this apparatus, the roller 1 is mounted upon a pivotal support S so that it can move upwardly and downwardly as a unit.

Thus the soil-loosening roller 1 is yieldably mounted and rotatable in the suction passage D of the vacuum cleaner and can be biased downwardly by a compression or tension spring not shown. The roller 1 is connected by a drive belt to the motor M and, to this end, the core 5 of the roller can carry a pulley R2 while the motor carries a pulley R1, the belt passing over these pulleys.

The motor M is disposed within a motor housing G centrally in the vacuum cleaner head so that the weight distribution of the latter brings about a uniform pressure of this head upon the carpet, i.e. the roller 1 and the nozzle edges of the intake opening O are pressed against the carpet uniformly over their entire length.

The support or frame S, which is swingably mounted on the motor housing G about the axis of the motor, permits a limited vertical swinging movement of the roller 1 while maintaining parallelity between the motor and roller axes. The opening O is made sufficiently wide that the roller 1 can descend sufficiently deeply into the carpet and the pile engages in the roots of the grooves between the annular disk projections thereof.

Atmospheric air passes upwardly into the opening O and around the roller 1 and is drawn from the suction passage D around the aerodynamically shaped housing G to the suction side of a blower not shown. The latter can be provided with a filter or the like in a canister tank, or upright vacuum cleaner configuration.

Figure 4:
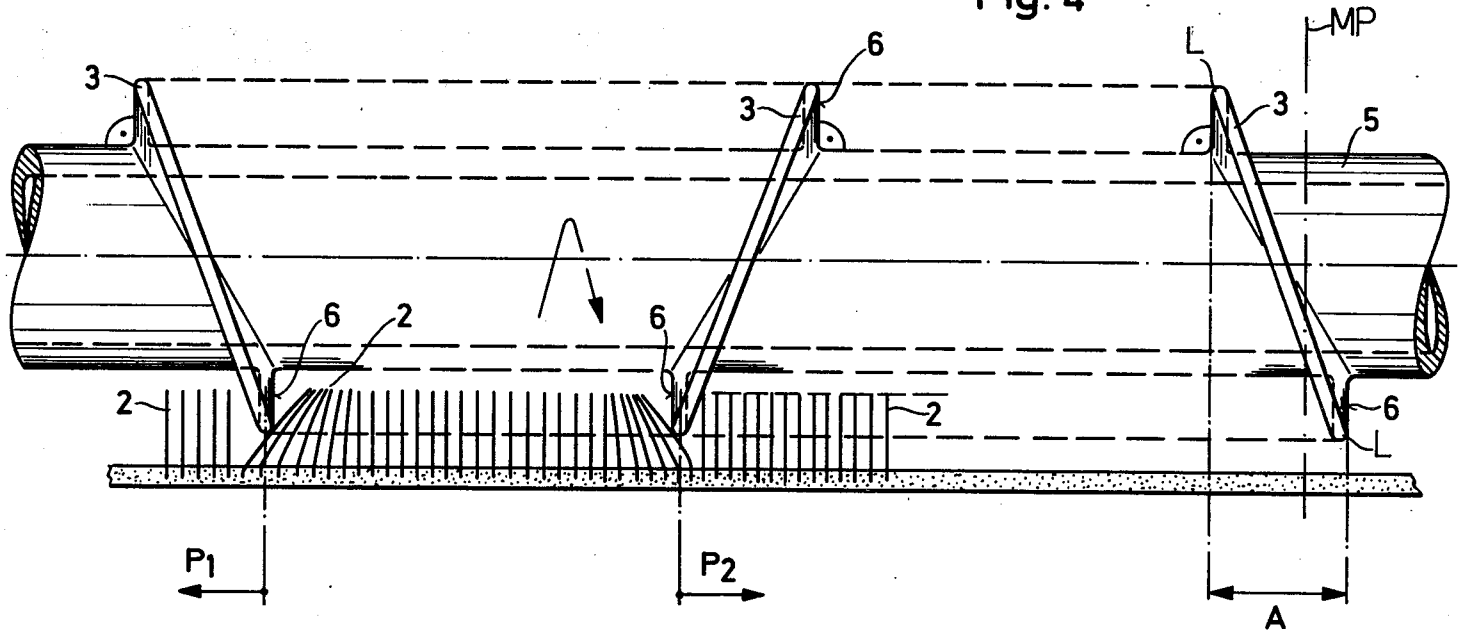
FIG. 4 is a schematic side-elevational view of a soil-loosening roller showing three annular projections thereof to demonstrate the forces which result from the use of this roller.

FIG. 4 shows an embodiment of the soil-loosening roller according to the invention in which the annular disk projections 3 are shown in some detail and penetrate into the pile 2 of the carpet. Each projection 3 is inclined to the axis of the roller which rotates in the direction illustrated by the arrow, i.e. clockwise as seen from the right-hand axial end. The outer edge of the projection 3 does not, however, lie in a plane and thus this edge is twisted out planarity. Furthermore, the projection is defined between cheeks or flanks which are surfaces always perpendicular to the cylindrical surface of the groove or the roller but forming a round or fillet therewith. The perpendicularity of the flanks or cheeks to the cylindrical surfaces of the roller has also been illustrated. The outer periphery of each projection can also be rounded and each projection has an axial excursion A between an extreme left and an extreme right position upon rotation of the roller. The throw of the outermost portions of the projection to opposite sides of a radial median plane MP is thus A/2. In the embodiment shown in FIG. 4, the projection has a simple incline and thus only one location L of greatest axial throw is provided to either side of the median plane NP. In this embodiment, thereforce, $a=1$.

The axial width of the groove between neighboring annular projections is less than A and hence the throws A/2 of each projection overlap that of the neighboring projection upon rotation.

FIG. 4 also shows the force neutralization discussed previously. Because of the angular offset of the successive projections through an effective angle of 360° between one side of the roller and the opposite end thereof, the net force acting in the direction $P_1$ and resulting from an opposite deflection of the pile is equal to the net force $P_2$ acting in the other direction. In all angular positions of the roller, therefore, the same force is applied to the right and to the left so that there is no resultant in any axial direction upon the roller or the machine in which it is journaled. Furthermore, the location L is here angularly offset from projection to projection by 360°/n where n is the number of projections, not counting the first, disposed along the roller. Naturally, where more than one location L is a maximum throw location, i.e. as when the projections are of undulating configuration, the angular offset between successive projections is 360°/n·a where a is the number of maximum throw locations L per projection.

As a comparison of the positions of the extreme left-hand projection 3 and the central projection of FIG. 4 will show, a rotation of the roller causes a deflection of the pile 2 to one side and then the other. This is the agitation and wiping effect as the projections penetrate into the pile and the pile penetrates into the grooves between the projections which results in the cleaning effectiveness described.

Figure 5:
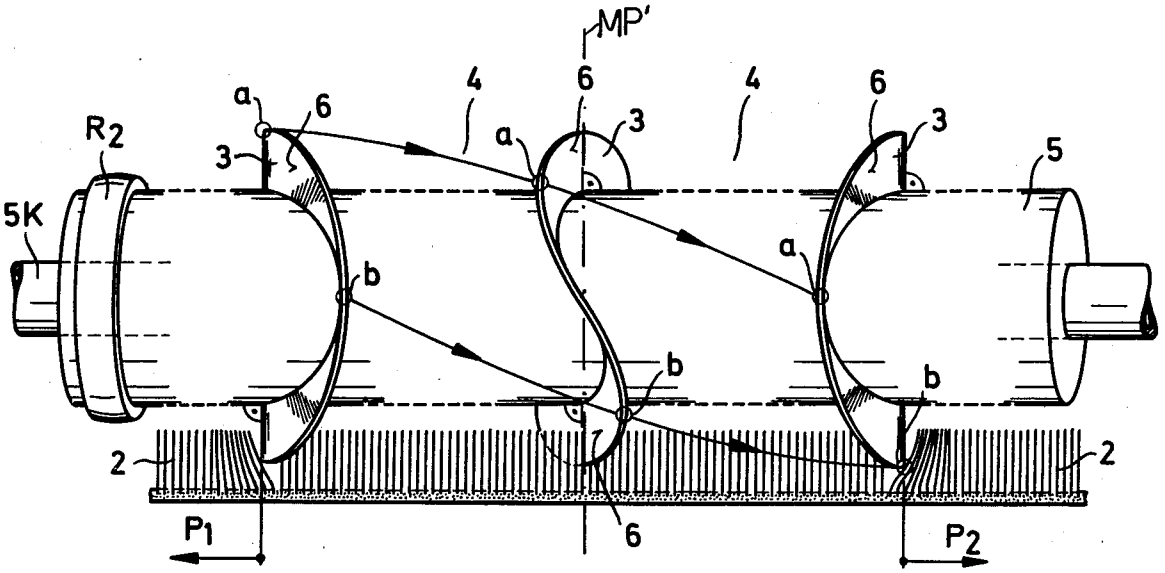
FIG. 5 is a view similar to FIG. 4 illustrating the force characteristics when the annular projections are of undulating configuration.
Figure 6:
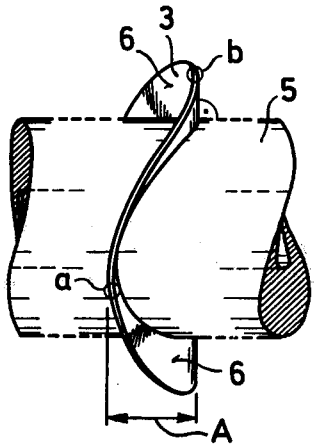
FIG. 6 is a side-elevational view showing one of the projections of FIG. 5 but partially rotated from the position illustrated in the latter Figure.

FIGS. 5 and 6 show another embodiment of the soil-loosening roller which has been found to be particularly effective for dry-operating carpet-cleaning machines. In this embodiment, the projections 3 are of undulating configuration and are provided with a multiplicity of bends over the circumferential length of each projection. Thus, each of the projections 3 illustrated in FIG. 5 has an elliptical configuration but a corrugated profile and has alternate crests a and troughs b. In this case, there are two locations a or b of greatest throw to opposite sides of a median plane NP' and $a=2$ in the relation 360°/n·a. Here again, the projections have their cheeks always perpendicular to the cylindrical surface of the grooves and cause a back and forth movement of the pile 2 which penetrates into the grooves between the projections 3.

As can be seen by the arrow connecting corresponding locations a and b of the projections 3 along the length of the roller, an angular offset along the roller length of 90° is sufficient to change the direction of force from $P_1$ to $P_2$. The individual projections need only be angularly offset from one another by 360°/n·a.

The projection 3 illustrated in FIG. 6 also has an axial throw A which can be greater than the width of the groove and can overlap the axial throw of the neighboring projection. With a roller width of 30 cm adjacent the belt pulley, there can be provided thirty-one annular disk projections on the roller, each of these projections having a thickness of 2 mm. The axial width or free space between adjacent projections ranges between 6 mm and 10 mm and the axial throw is about 15 mm. The rotation of the roller provides, for each revolution, two displacements of the pile of the carpet to the left and two to the right.

Figure 7:
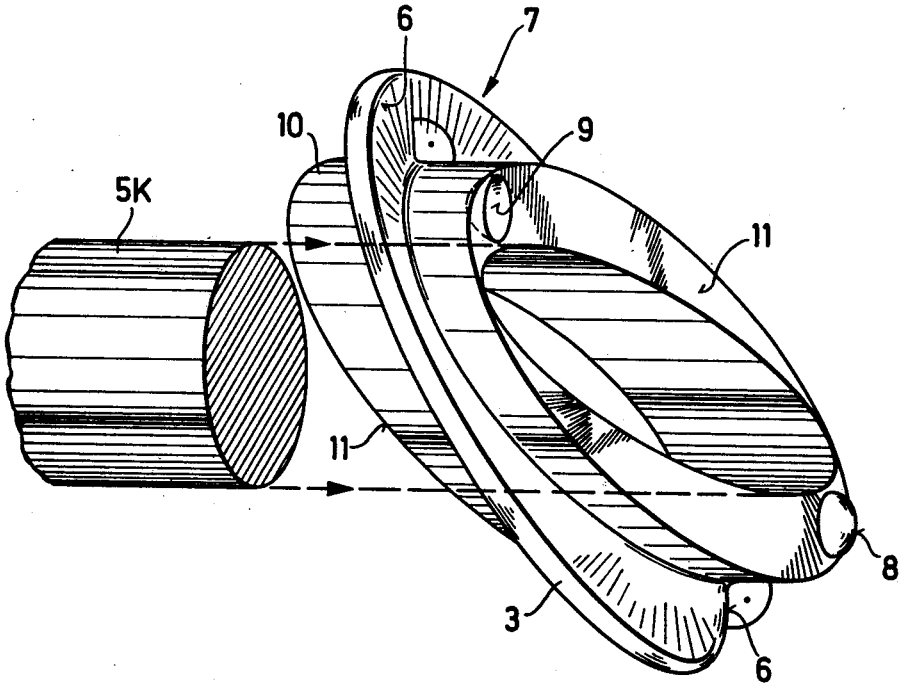
FIG. 7 is a side-elevational view showing a segment of a soil-loosening roller according to the invention.

FIG. 7 shows that the roller of the present invention can be assembled by mounting individual structural elements or segments upon a shaft 5K which can constitute the driveshaft of the roller and can form or be provided with the pulley engageable by the belt. Each of the elements is constituted as a sleeve 10 which is molded with the respective projection 3 and the surfaces which constitute the cheeks and floor of the respective groove.

The ends of the sleeve are provided with end faces 11 which have hemispherical projections 8 and recesses 9 interengageable with one another to control the segments successively applied to the shaft together for joint rotation. From one face to the other face of each segment, the formations 8 and 9 are angularly displaced by the desired angular offset between the projections 3.

While for rollers of normal length it suffices to provide a shaft 5K at each end and to hold the assembly of segments between a pair of end members, the shaft can extend through the entire assembly or a reinforcing spline can be provided at the center of the roller, if desired, in the case of longer assemblies.

It has been found to be advantageous to form the faces 11 as generally radial and perpendicular to the axis although a slight twist can be provided hereto with the opposite faces angularly offset by, for example, 12° when the roller is to carry thirty-one projections of the type shown in FIG. 7. In this embodiment each projection has a thickness of 2 mm, the groove depth, i.e. the radial height of the projection is 7 to 8 mm and the fillet between the projection and the wall of the groove can have a radius of curvature of 3 mm. With an angular offset of 12°, the groove can have an axial width ranging between 4.5 and 8 mm and the axial throw between the opposite edges of the projection can be 15 mm. If the axial spacing of the projection is about 6 mm, this results in a double overlap of the action at each groove.

Figure 8:
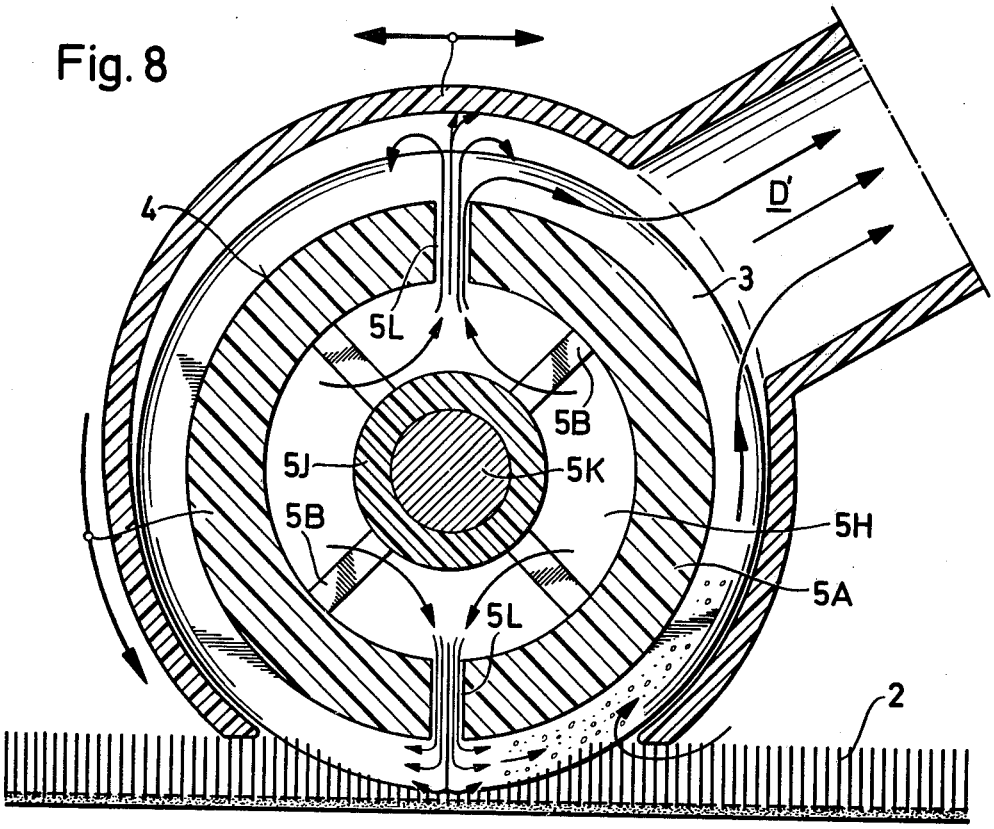
FIG. 8 is a transverse cross section through a portion of a carpet-cleaning machine provided with a soil-loosening roller corresponding to another embodiment of the invention.

FIG. 8 shows how the roller can be disposed in a suction passage D' connected with the vacuum duct for a floor-cleaning unit in which the roller is provided as soil-loosening means. In this case, the duct D is connected to a canister suction source by a rigid tube and a flexible hose not shown. The generally cylindrical mouth of the suction passage D', has a window which is turned to the floor and within which the roller is drivingly received. This window has a width sufficient to allow the roller to penetrate into the carpet to the full height of the pile or at least to a depth equal to the depth of the angular grooves between the annular projections of the roller.

The roller here comprises a plurality of segments assembled in axially interengaging relationship and formed with sleeves 5A which carry the annular projections 3. The sleeves 5A define the cylindrical floors of the grooves between the projections.

In the opposite end faces, each segment is provided with a radial slot 5L as shown for the end face 11L so that, when the segments are connected together as previously described, these grooves form radial passages communicating with the hollow interior 5H of the roller.

The sleeves 5A forming the shell of the roller are supported by spokes 5B on respective hubs 5J which are rotatably entrained by the shaft 5K on which they are fitted.

Upon rotation of the soil-loosening roller, air is displaced outwardly through the passages 5L and sweeps the grooves of the roller clean. The air is drawn from the interior 5H of the roller which can communicate with the ambient atmosphere.

The outward displacement of air is a result of the suction force generated in the nozzle as well as the centrifugal displacement action of the driven roller. The air is effective to loosen particles of soil from the base of the carpet whole pile is deflected to the side by the respective annular projections. The influx of air below the edges of the window and the outflow of air from the roller causes a strong turbulent mixing of the region of the carpet to promote soil loosening and removal. The rotation of the roller also sweeps the air jets around to promote loosening of the soil particles and clearing of the roller.

Figure 9:
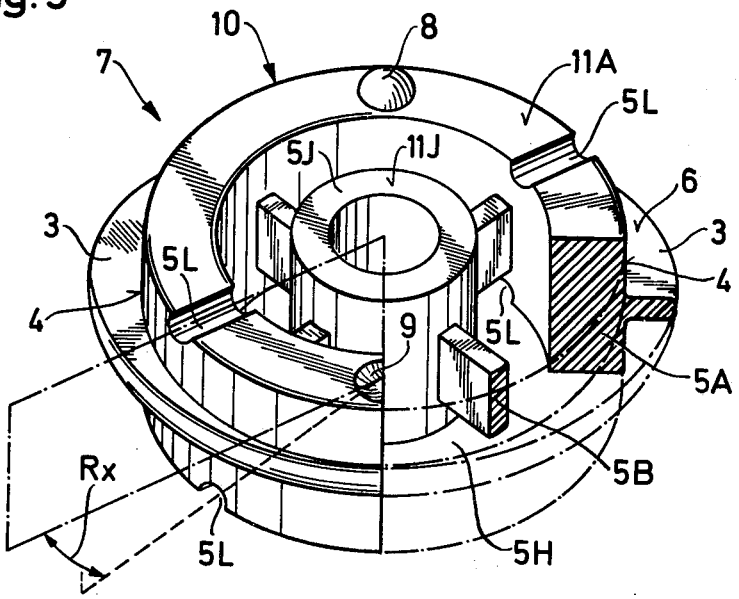
FIG. 9 is a perspective view, partly broken away, of a segment of this other soil-loosening roller of the present invention.

From FIG. 9 it will be apparent that each segment 7 has spokes 5B which extend only over part of the axial length of the respective segment. This prevents the spokes of the array of segments from partitioning the interior into separate compartments. The surfaces 11A and 11J which are provided with the formations 8 and 9 lie perpendicular to the axis of the assembly. Otherwise the device has the configuration and function described. The angle $R_x$ represents the angular offset between adjacent segments.

I claim:

1. A rapid-rotation soil-loosening roller for a carpet-cleaning machine comprising:

an elongated body of shape-retentive material having an axis and a multiplicity of annular projections with continuous peripheries of circular outline in projection on a plane perpendicular to said axis, the periphery of each projection having at least two points of maximum excursion angularly offset from one another about said axis and lying on opposite sides of a median plane therebetween perpendicular to said axis, the periphery of each projection undergoing axial excursion with respect to the carpet upon rotation of said body about said axis, said projections having oppositely facing cheeks lying at right angles to said axis and defining annular grooves between said projections, said projections being angularly offset from one another along the length of the roller with the maximum excursion points of successive projections being angularly offset from each other so that the net axial reaction force on said roller when said roller is rotated in contact with the pile of a carpet because of opposite deflection of said pile is zero.

2. The roller defined in claim 1 wherein n projections are provided along said axis not counting a first projection at one end thereof and each of said projections has a locations of maximum axial excursion to each side of a respective median plane perpendicular to the axis through the respective projections and the angular offset between neighboring projections is 360°/n·a.

3. The roller defined in claim 2 wherein the axial displacement at said points to opposite sides of the respective median plane constitutes the throw of each respective projection, the throws of the respective projections overlapping the throws of the neighboring projections.

4. The roller defined in claim 3 wherein each of said projections has only one location on each side of the respective median plane which defines the axial throw of the respective projections.

5. The roller defined in claim 3 wherein each of said projections has a plurality of bends to opposite sides of the respective median plane and a is thereby at least 2.

6. The roller defined in claim 3 wherein each of said projections is formed upon a respective structural element, said structural element being assembled axially into said roller and being connected together by matingly engageable axial formations.

7. The roller defined in claim 6 wherein said elements are hollow, further comprising a shaft received in said elements at least at one end thereof, said shaft being provided with a pulley capable of driving said roller.

8. The roller defined in claim 6 wherein said elements have juxtaposed faces provided with said formations and lying in planes primarily perpendicular to said axis.

9. The roller defined in claim 8 wherein said formations include a hemispherical projection on one of said faces and a complementary hemispherical recess in the juxtaposed face.

10. The roller defined in claim 6 wherein said elements define a hollow interior of said roller and said roller is formed with air passages communicating between the hollow interior of said roller and the roots of said grooves.

11. The roller defined in claim 10 wherein said passages have lengths that are three to four times their respective diameters.

12. The roller defined in claim 11 wherein said elements each have sleeve forming the respective roots of said grooves and carrying the respective projections, hubs disposed coaxially with said sleeves, and angularly spaced ribs connecting said hubs with said sleeves, said sleeves being formed with said passages and said hollow interior being provided between said hubs and said sleeves.

13. The roller defined in claim 3 wherein said grooves are provided with passages communicating with atmospheric air through which air can be drawn out into said grooves.

14. An apparatus for carpet cleaning comprising a housing, a roller as defined in claim 3 journaled in said housing, means on said housing for rotating said roller about its axis, and means on said housing inducing a flow of air in the region of said roller to remove soil particles from said carpet loosened by said roller.

* * * * *